US006280321B1

(12) United States Patent
Jones et al.

(10) Patent No.: US 6,280,321 B1
(45) Date of Patent: Aug. 28, 2001

(54) AIR DIFFUSER HAVING IMPROVED BRIDGES FOR SUPPORTING AIR CONTROL BLADES

(75) Inventors: Gordon G. Jones; Gerald Cook, both of Tuscon, AR (US)

(73) Assignee: Air System Components LP, Dayton, OH (US)

( * ) Notice: Subject to any disclaimer, the term of this patent is extended or adjusted under 35 U.S.C. 154(b) by 0 days.

(21) Appl. No.: 09/484,779

(22) Filed: Jan. 18, 2000

(51) Int. Cl.[7] ..... F24F 7/00
(52) U.S. Cl. ..... 454/303; 454/301
(58) Field of Search ..... 454/301, 302, 454/303, 304

(56) References Cited

U.S. PATENT DOCUMENTS 3,220,332 * 11/1965 Straub ..... 454/301
3,260,188 * 7/1966 Person ..... 454/301
3,815,486 * 6/1974 Morrison ..... 454/301
4,182,227 * 1/1980 Roy ..... 454/301
5,014,609 * 5/1991 Weck ..... 454/304
5,052,285 * 10/1991 Rich ..... 454/304
5,261,857 * 11/1993 Petterson et al. ..... 454/304

* cited by examiner

*Primary Examiner*—Harold Joyce
*Assistant Examiner*—Derek S. Boles
(74) *Attorney, Agent, or Firm*—Shughart Thomson & Kilroy P.C.

(57) ABSTRACT

A slot diffuser includes a pair of elongate and parallel side walls spaced by pairs of bridges. The bridges include feet that slide along receivers in the side walls such that the bridges can be positioned at any location therealong and provide support to the bridges and stability to the diffuser. The bridges include slots that extend between the side rails and that receive ends of air flow control blades. The air flow control blades have an elongate planar portion supported by rods extending outwardly on either side of the planar portions to support the blades in the slots. The blades are removable without disassembling the entire diffuser. Each bridge has an arcuate cover that reduces air drag and each bridge also has a low profile to further reduce air drag and thus reduce noise produced by the diffuser.

17 Claims, 3 Drawing Sheets

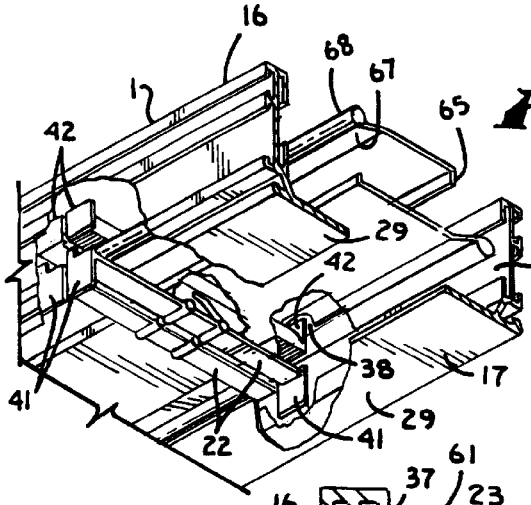
Fig.2.
Fig.3.
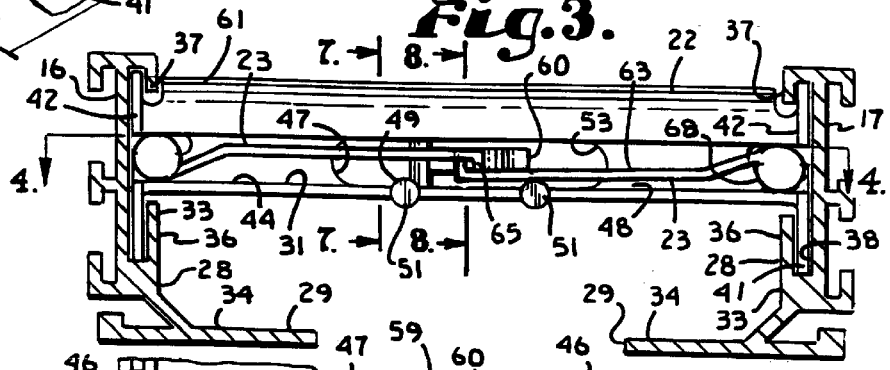
Fig.4.
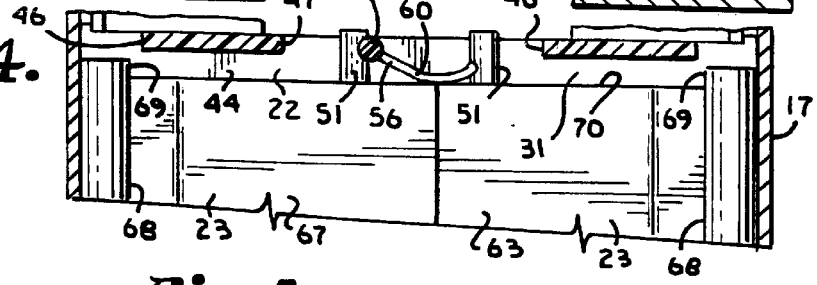
Fig.5.
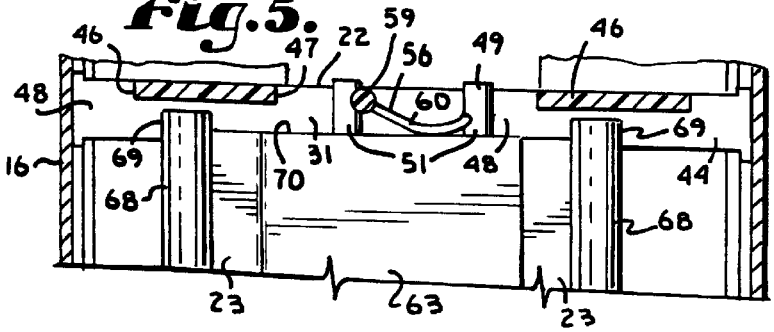

AIR DIFFUSER HAVING IMPROVED BRIDGES FOR SUPPORTING AIR CONTROL BLADES

BACKGROUND OF THE INVENTION

The present invention is directed to slot air diffusers or airbars that control and distribute air from a heating and cooling ventilation system into a room and, in particular, to improvements in bridges that support air control blades within such diffusers.

Air diffusers are utilized to distribute air into a room from a plenum in such a manner as to control the direction of the air into the room and/or the volume of flow of air from each diffuser. Such diffusers may be mounted in a ceiling, walls or other structures as required by the particular architectural need and the present invention is designed for any such uses.

Many types of diffuser have existed in the prior art such as is shown in the Hungerford U.S. Pat. No. 5,001,967. Such diffusers often include a body or frame with side rails connected by bridges that in turn support air control blades.

Prior art bridges have been restrictive as to the positioning of the air control blades supported by the bridges. Furthermore, the bridges of the prior art are normally designed such that the entire diffuser must be disassembled when it is necessary to replace a control blade or it becomes desirable to be able to exchange one type of control blade for a different style blade. It is desirable to make such changes without disassembly of the diffuser or of room structure around the diffuser. Also, it is normally important to limit noise produced by air diffusers. Prior air diffusers have bridges that create very turbulent air flow about the bridges and are therefore quite noisy. The air control blades also often vibrate or rattle in the air flow making additional noise.

Therefore, it is desirable to have a diffuser and especially a bridge for such a diffuser that overcomes these problems.

SUMMARY OF THE INVENTION

An air diffuser is provided that operates in conjunction with an air delivery plenum to supply heating and ventilation air to a room under directional and volume control of the diffuser. The diffuser includes a pair of slide rails joined by end plates in such a manner as to be operably mountable within a ceiling or a wall surface and to be flow joined with an air delivery plenum. The diffuser also includes at least one pair of bridges which are positioned opposed to each other and a set of air flow control blades which are mounted in and extend between the bridges. The bridges each include a slot for receiving an end of each blade such that the blades may move laterally from side to side within the slot and such that the blades are preferably in overlapping relationship with one another in at least some configurations of the diffuser.

The blades are generally parallel to one another and are slidable relative to each other, as well as to the bridges, so as to be selectively positionable within the diffuser. In this manner the blades may as a pair be positioned anywhere between being fully to one side of the diffuser or fully to the opposite side of the diffuser. Furthermore, the overlap of the blades may be varied to allow more or less spreading therebetween. That is, as the blades slide relative to each other to a more separated position, the space obstructed by the blades increases, thereby producing a greater obstruction to air, and in this way air flow is dampened. For increased flow the blades are positioned for greater overlap. Moving the blades from side to side changes the directional output of the air from the diffuser. Thus, the blade design allows for a wide variety of directional air flows, as well as volumes of air flow through the diffuser.

Each of the bridges includes a spring arm that is located within the slot that receives the blades and which engages both of the blades. The spring arm provides a constant bias to the blades that maintains the blades in spaced relationship with respect to a rear wall of each slot, so as to reduce the likelihood that a blade will become wedged against the wall. This allows free movement of the blades within the slot for purposes of adjustment. Furthermore, the spring arm provides a constant small amount of bias to each of the blades so as to prevent the blades from rattling within the diffuser as air passes the blades. The bridges have feet at each end that are slidably mounted in receivers in the side rails to allow movement of the bridge along the side rails, but yet provide support to the bridges. Each bridge also includes a cover. The cover is curved and higher near the back of each bridge then on a blade receiving side. Preferably, the covers are arcuate and have a radius that approximates the thickness of the bridge.

OBJECTS AND ADVANTAGES OF THE INVENTION

Therefore the objects of the present inventions are: to provide a slot air diffuser that includes bridges that allow for easy manual adjustment of air flow blades supported by the brides; to provide such a diffuser wherein the bridges allow easy change out or repair of the air control blades without disassembly of the diffuser or surrounding room structure; to provide such a diffuser wherein the bridges provide biasing to the blade to reduce noise and rattling of the blades in the air flow; to provide such a diffuser wherein the bridges have a low profile so as to produce a comparatively small footprint with respect to the air flow through the diffuser to reduce noise due to turbulence produced at the bridge; to provide such a diffuser having a top that has a radius equal to the thickness of the bridge to reduce air turbulence and noise associated with the bridge; to provide a diffuser having a bridge that interconnects with and slides along side rails of the diffuser to allow for easy positioning of the bridge and so as to make the bridge self supporting, such that the air control blades may be removed therefrom without removing the bridges; to provide such diffuser wherein a single bridge may be used with more then one type of air control blade; and to provide such a diffuser that is easy to construct, requires comparatively few parts, is simple to install, is inexpensive to produce and is especially well suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 is a fragmentary perspective view from below the air diffuser, showing side rails, the bridges and a pair of blades, with portions broken away to show internal detail thereof.

FIG. 3 is a cross-sectional view of the air diffuser, taken along line 3—3 of FIG. 1.

FIG. 4 is a cross-sectional view of the air diffuser, taken along line 4—4 of FIG. 3, illustrating interaction of the blades with a spring arm and with the blades positioned to be fully spread and blocking flow of air through the diffuser.

FIG. 5 is a cross-sectional view of the air diffuser, taken along the same line as FIG. 4, illustrating the interaction of the blades with the spring arm and with the blades fully overlapping so as to maximize air flow through the diffuser.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
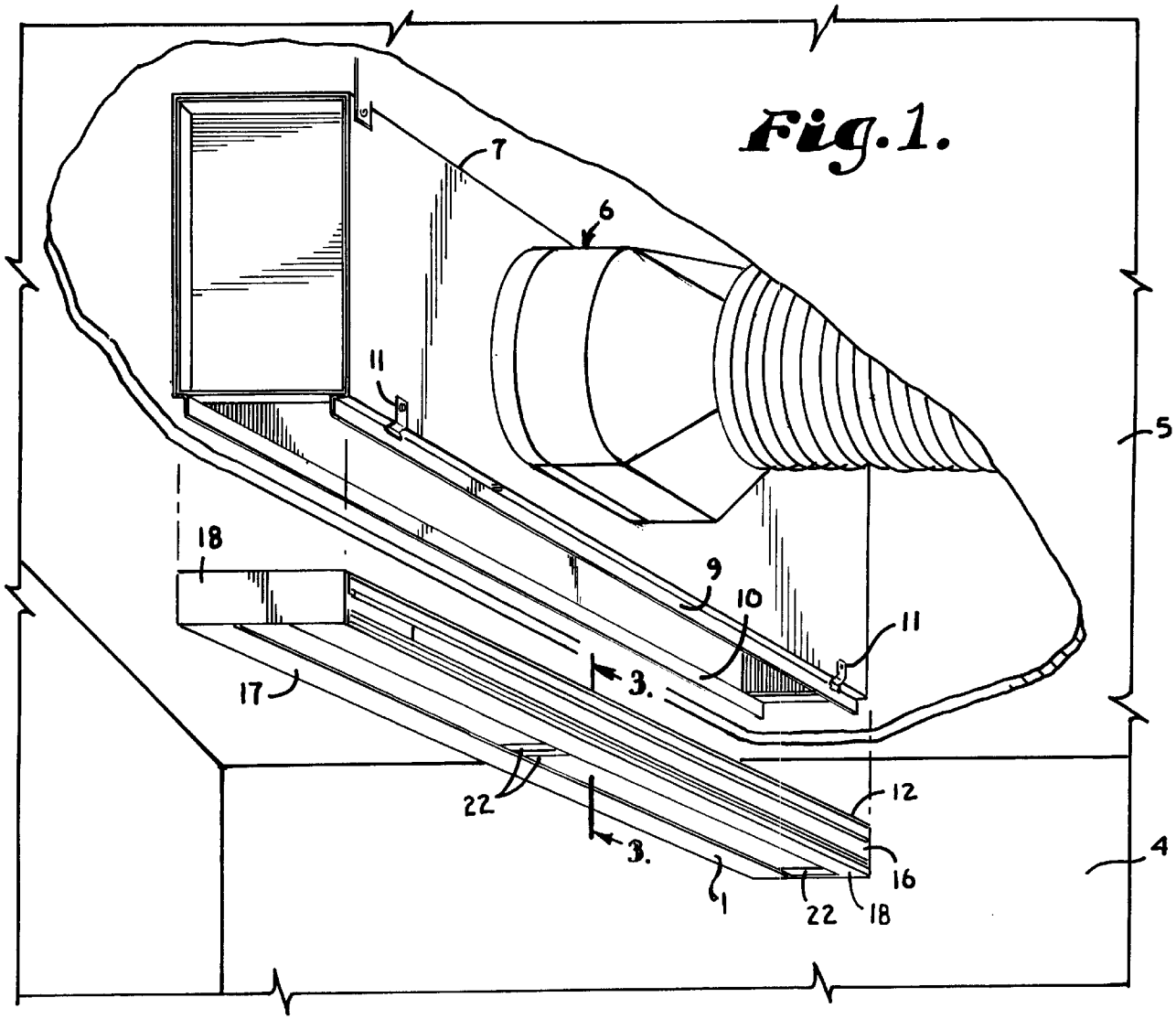
FIG. 1 is a perspective view of a ceiling with a diffuser having blade supporting bridges in accordance with the present invention, shown spaced from an air delivery plenum in the ceiling just prior to final assembly, with portions of the ceiling broken away to show detail thereof.

The reference in numeral 1 generally designates an air bar or slot air diffuser in accordance with the present invention. The diffuser 1 is shown in FIG. 1 just prior to final installation in a room 4. The room 4 has a ceiling 5 with an air distribution plenum 6 located above the ceiling 5 opening into a boot 7. The boot 7 has flanges 9 and 10 that mate with the diffuser 1 and a plurality of snaps or fasteners 11 which secure the diffuser 1 to the plenum 6 and, in particular, to the boot 7. In this manner air being distributed by the plenum 6 is supplied to the top or plenum facing side 12 of the diffuser 1. As used herein the terms top and bottom refer to the diffuser 1 as seen in FIG. 3; however, it is foreseen that the diffuser of the present invention may be used in a variety of orientations, such as in ceilings, walls or the like and the terms refer to direction within the diffuser and not room direction.

Figures 6, 7, 8:
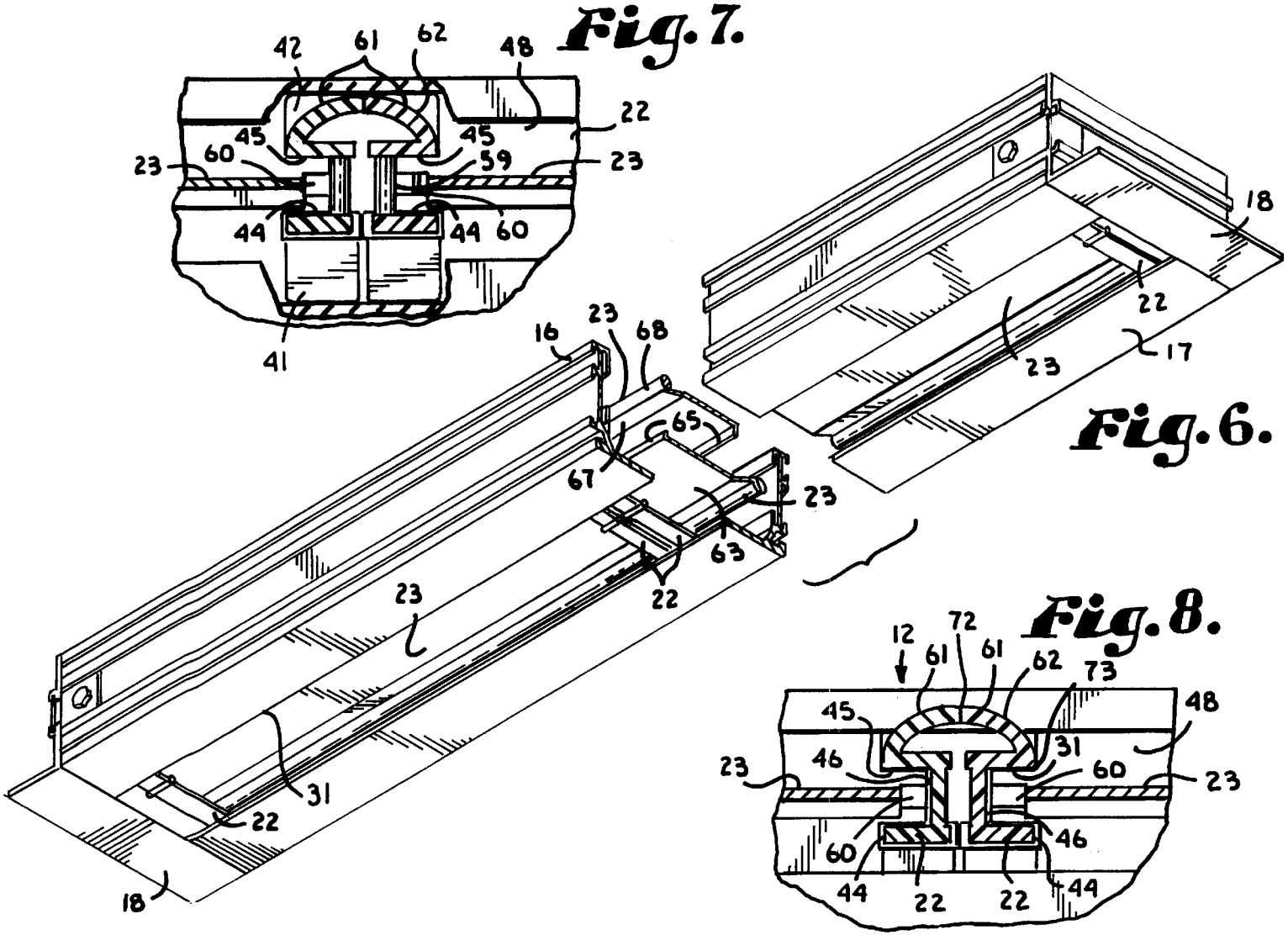
FIG. 6 is an enlarged and fragmentary perspective view of the air diffuser from below with portions broken away to show detail.
FIG. 7 is an enlarged and fragmentary cross sectional view of a bridge of the air diffuser, taken along line 7—7 of FIG. 3.
FIG. 8 is an enlarged and fragmentary cross sectional view of a bridge of the diffuser, taken along line 8—8 of FIG. 3.

The diffuser 1 includes a pair of side frame rails 16 and 17 joined at opposite ends by end plates 18. The diffuser 1 also includes two pairs of bridges 22 (see FIG. 2) and two pairs of air pattern controller blades 23 (FIG. 6). In particular, this diffuser 1 has two sets of blades 23 which may be the same or different, depending on the needed air distribution. It is foreseen that at diffusers 1 may have only one set of blades 23 or multiple adjacent sets, as needed.

The frame rails 16 and 17 are generally elongate and each has a sidewall 28 and a bottom flange 29 that extends outwardly from the lower or outer most edge of each side wall 28 in facing relationship to the flange 29 of the opposite side rail, but spaced so as to form a slot 31 therebetween. Each side wall 28 has an interior surface 33 (FIG. 3), such that the surfaces 33 of opposed side walls 28 face each other. Likewise each bottom flange 29 has an inward facing or interior surface 34 that is generally perpendicular to the flow of air through the diffuser 1.

The surfaces 33 and 34 cooperate with the blades 23 to control the directional flow of air through the diffuser 1. Each side wall 28 also includes upper and lower flanges 36 and 37 that cooperate to form a receiver 38 within which a respective side of each of the bridges 22 is received in such a manner as to allow the bridges 22 to be slidably positioned along the rails 16 and 17.

Each of the bridges 22 is sized and shaped to span between a pair of opposed side rails 16 and 17. Each of the bridges 22 has a pair of feet 41 and 42 (FIG. 2) that extend in opposite directions and are sized and shaped to be slidably received in the receivers 38. The bridges 22 are thus supported by the side rails 16 and 17, but are slidable in the receivers 38 during assembly and during certain modifications of the diffuser 1.

Each bridge 22 has a lower wall 44 and an upper wall 45 (FIGS. 7 and 8) that extend between the feet 41 and 42, are parallel to one another and are spaced by a rear wall 46. For each bridge 22 the lower wall 44, upper wall 45 and rear wall 46 form a blade receiving slot 48 (FIG. 8) that operably slidably receives the blades 23. The rear wall 46 has a central aperture 47 (FIG. 4) located therein. Each of the slot lower walls 44 include a pair of spaced rests 51 that are cylindrical in shape and protrude upwardly from the surface of the lower wall 44 to expose a semi-circular surface 49. The rests 51 are aligned parallel to the frame rails 16 and 17 and are spaced from each other. The rear wall aperture 47 includes a portion 53 that is located just laterally with respect to the rests 51. Mounted in each of the slots 48 between the rests 51 is a spring arm or member 56. Each spring member 56 includes a mounting post 59 that extends between the lower wall 44 and upper wall 45 in close proximity to the rear wall 46 and a spring 60. Each spring 60 is elongate and curves so as to be arcuate and so as to be bowed outwardly from the rear wall 46. Each spring 60 is positioned to engage the blades 23 associated therewith, as will be discussed below.

Each bridge 22 has a cover 61 that includes a curved or arcuate top surface 62 that is rounded with a radius, that is approximately equal to the thickness of the bridge 22 and that allows smooth transition with the slot upper wall 45 from a rear 72 to a front 73 (see FIG. 8) thereof. The rounded feature of the surface 61 reduces drag of air across the bridge 22 and thus reduces noise created by air passing the associated bridge 22, as this air is less turbulent. Each of the blades 23 includes a generally planar and elongate portion 63 joined along an edge thereof to a rectangular shaped rod or lip 65 that is slightly larger than the planar portion 63 and at an opposite end to a ramp 67 and a round second rod 68 that is comparatively larger in diameter than the thickness of the planar portion 63.

The rod 68 is approximately the same size as the slot 48 so as to be received completely therein in such a manner as to allow the blades 23 to slide within the slots 48. The rods 68 are slightly longer than the remaining parts of each blade 28, including the planar portion 63, ramp 67 and rod 65. In this manner the rods 63 have pegs or posts 69 that are slot followers and are received further into the slot 48 then remaining portions of the blade 23. As is seen in FIGS. 3 through 5, the planar portions 63 of the blades 23 have ends 70 that are supported on the rests 51 and abut against a respective spring 60.

In use the diffuser 1 blades 23 may be positioned from side to side or with more or less overlapping as is necessary to direct air. The blades 23 may be removed by pushing toward one bridge 22 to overcome the spring 60 and allow the posts 69 to enter the aperture 47. At this time the opposite end of the blade 23 may be moved away from the slot 48 and the blade 23 is then completely removed. The reverse procedure allows replacement of a repair blade 23 or a completely different type of blade, as needed.

It is to be understood that while certain forms of the present invention have been illustrated and described herein, it is not to be limited to the specific forms or arrangement of parts described and shown.

What is claimed and desired to be secured by Letters Patent is as follows:

1. An air diffuser bridge for mounting air control blades; said bridge comprising:

a) a bridge body having an elongate slot for receiving at least one air control blade; said slot having associated therewith a top elongate wall and a planar bottom wall spaced parallel to said top wall by a rear wall, said slot being adapted to slidably receive a control blade therealong; said top wall having a cover; said cover being arcuate and curving downward from near a rear thereof to near a front of said slot top wall so as to reduce drag on air passing said cover.

2. The bridge according to claim 1 wherein:

a) said cover has a radius that is approximately equal to the thickness of said bridge.

3. The bridge according to claim 1 that is a first bridge in combination with a second bridge; said first and second bridges abutting in back to back relationship; the covers of said first and second bridges forming an elongate structure having a semicircular cross section.

4. The bridge according to claim 1 wherein:

a) said slot rear wall has at least one aperture therealong for operably receiving a portion of a control blade during assembly.

5. The bridge according to claim 1 wherein:

a) said slot contains a spring mechanism for operably biasing against an air control blade during use.

6. The bridge according to claim 5 wherein:

a) said spring mechanism includes an arcuate spring sized and positioned to abut an air control blade mounted in said slot.

7. The bridge according to claim 6 wherein:

a) said spring mechanism includes a post upon which said spring is mounted; said post extending between said top and bottom walls and being located near said rear wall.

8. The bridge according to claim 1 including:

a) a pair of slide feet mounted on respective opposite ends of said slot and sized and shaped to be slidingly received on a pair of diffuser rails respectively.

9. The bridge according to claim 8 in combination with a pair of side rails and wherein:

a) said side rails each include an elongate receiver for slidably receiving said bridge feet.

10. The combination according to claim 9 wherein said bridge is a first bridge and including a second bridge spaced from said first bridge and secured to said side rails; said first and second bridges mounting a pair of air control blades therebetween.

11. The combination according to claim 10 wherein:

a) each of said blades includes a planar portion extending between said bridges and a pair of mounting pegs extending outwardly from said planar portions from respective opposite ends thereof; each of said pegs being slidingly received in a slot of a respective bridge and opposite ends of each planar portion positioned to engage a respective spring member during use.

12. An air diffuser comprising:

a) a pair of parallel spaced side rails; each rail having an elongate receiver;

b) a pair of bridges slidably joined to said side rails; each of said bridges including an elongate body with slide feet positioned at opposite ends thereof; each of said bridge feet being captured in a respective side rail receiver such that said bridges are supported by said side rails but slidable therealong; each of said bridges also having an elongate slot formed of a bottom wall, rear wall and top wall; each of said bridges having a respective spring mechanism mounted in a slot thereof; each of said bridges also having a cover over each top wall; each of said covers having a radius approximately a thickness of an associated bridge so as to reduce drag on air passing each bridge; and c) a pair of air control blades; each blade being elongate and having a planar portion extending between a pair of bridges; each blade also having a pair of mounting pegs extending outward from opposite sides of a respective blade planar portion; said pegs being received in respective bridge slots; said blade planar portion opposite ends each being received against a respective spring member.

13. In an elongate air diffuser bridge for operably joining together a pair of side rails and operably supporting at least one air control blade; the improvement comprising:

a) said bridge having a top and opposed first and second sides, said first side being a control blade receiving side having a control blade receiving slot formed therein, said bridge including a cover extending along said top thereof; said cover sloping downwardly from said second side of the bridge to said control blade receiving side of the bridge.

14. The bridge according to claim 13 wherein:

a) said cover is arcuate.

15. The bridge according to claim 14 wherein:

a) said bridge has a thickness; and b) said cover has a radius substantially equal to the thickness of said bridge.

16. An air diffuser comprising:

a) a first bridge including:

i) a bridge body having an elongate slot; said slot having associated therewith a top elongate wall with a cover; said cover being arcuate and curving downward from near a rear thereof to near a front of said slot top wall so as to reduce drag on air passing said cover; and ii) a pair of slide feet mounted on respective opposite ends of said slot;

b) a pair of side rails, each of said side rails including an elongate receiver slidably receiving a respective one of said slide feet;

c) a second bridge spaced from said first bridge and secured to said side rails; and d) a pair of air control blades mounted between said first and second bridges.

17. The air diffuser according to claim 16 wherein:

a) each of said blades includes a planar portion extending between said bridges and a pair of mounting pegs extending outwardly from said planar portions from respective opposite ends thereof; each of said pegs being slidingly received in a slot of a respective bridge and opposite ends of each planar portion positioned to engage a respective spring member during use.

* * * * *